US005101996A

United States Patent [19]

Mosley

[11] Patent Number: 5,101,996

[45] Date of Patent: Apr. 7, 1992

[54] PORTABLE PAIL

[76] Inventor: Coley Mosley, 150 Coleman Cir., P.O. Box 524, Pacolet, S.C. 29372

[21] Appl. No.: 694,876

[22] Filed: May 2, 1991

[51] Int. Cl.[5] ..... B65D 23/00

[52] U.S. Cl. ..... 220/8; 206/218

[58] Field of Search ..... 220/8, 912; 206/218

[56] References Cited

U.S. PATENT DOCUMENTS

| | | | |
|---|---|---|---|
| 561,167 | 6/1896 | Jennings | 220/8 |
| 1,020,347 | 3/1912 | Follett | 220/8 |
| 1,097,690 | 5/1914 | Ward | 220/8 |
| 1,224,519 | 5/1917 | Brenner et al. | 220/8 |
| 1,607,095 | 11/1926 | Miller | 220/8 |
| 2,990,970 | 7/1961 | Murdock, Sr. | 220/8 |
| 4,930,644 | 6/1990 | Robbins, III | 220/8 |

*Primary Examiner*—Joseph Man-Fu Moy

*Attorney, Agent, or Firm*—Bailey & Hardaway

[57] ABSTRACT

A novel pail is provided comprising a plurality of tapered side sections including at least a top and bottom side section, the side sections being nested one to another in series such that the sections may be collapsed into a completed nested assembly or extended to a fully telescoped assembly in the form of a pail.

6 Claims, 1 Drawing Sheet

FIG. 1
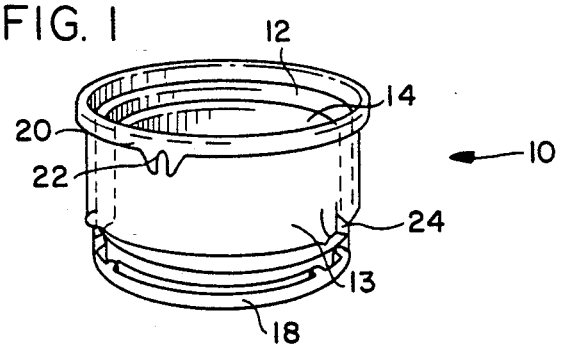
FIG. 2
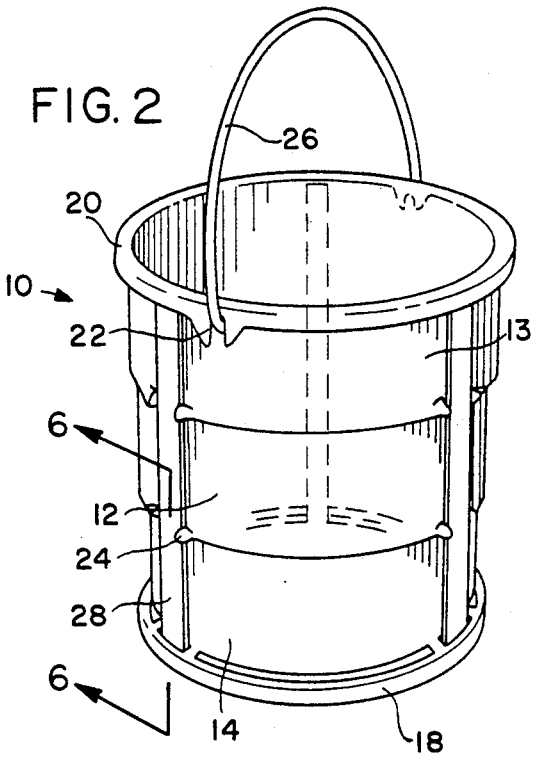
FIG. 4
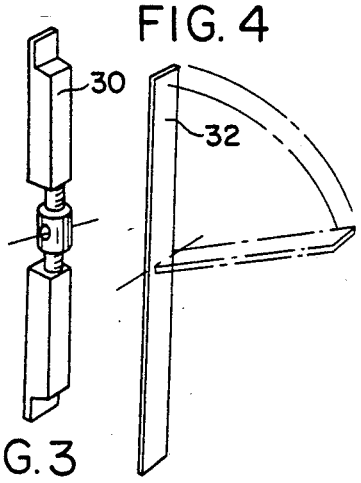
FIG. 3
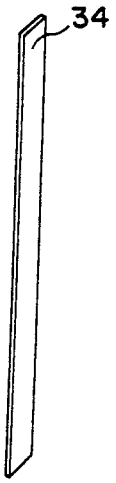
FIG. 5
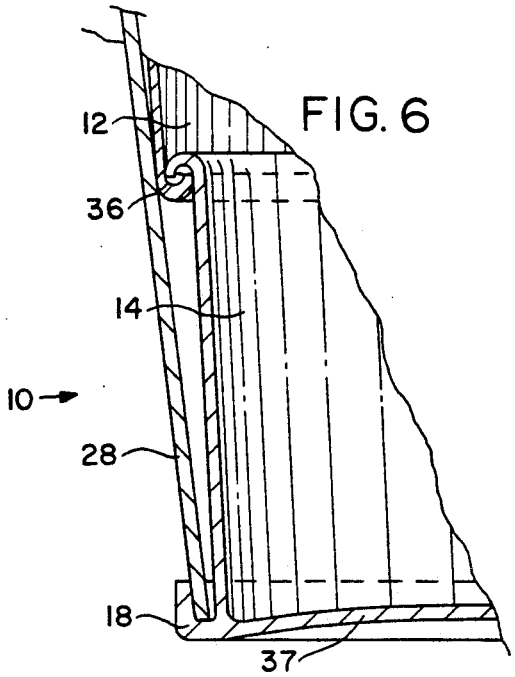
FIG. 6
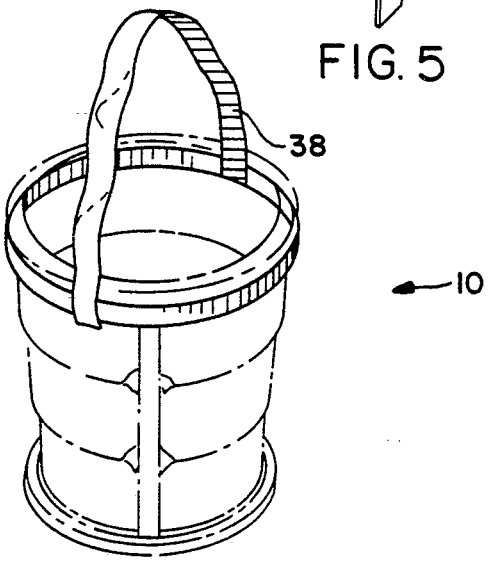
FIG. 7

PORTABLE PAIL

BACKGROUND OF THE INVENTION

This invention relates generally to the art of containers and more particularly to the art of portable pails.

It is known in the prior art to provide a container which is collapsible in some manner. The Boy Scouts of America have long been using such a container, which is a small, collapsible cup ideally intended for holding small quantities of water. This collapsible cup is specifically designed for holding a small volume of liquid, such as would be sufficient for use with a meal or at a waterbreak.

In the fishing art there have been fabric containers utilized but such containers are not self-supporting. Thus when fishing, it has been necessary to transport bulky containers to effectively retain fish.

There has to date, however, been no nonbulky container provided which is adapted for holding a large volume of materials, including liquids, therein, and which functions as a portable pail.

SUMMARY OF THE INVENTION

It is thus an object of this invention to provide a novel portable pail.

It is still a further object of this invention to provide such a pail which is self-supporting.

It is yet a further object of this invention to provide such a pail which is collapsible to a small volume.

These as well as other objects are accomplished by a pail comprising a plurality of tapered side sections including at least a top and bottom side section with the side sections nested one to another in series such that the sections may be collapsed into a nested assembly or extended to a telescoped assembly in the form of a pail, a closed bottom generally perpendicular to the side sections, a stiffener bar fitted lengthwise across the side sections when the sections are in a fully telescoped position, and a handle attached to the top side section of the pail.

Other objects and a fuller understanding of the invention will become apparent from the following description given with reference to the various figures of drawing.

BRIEF DESCRIPTION OF THE DRAWINGS

FIG. 1 is a perspective view of the portable pail in a collapsed position.

FIG. 2 is a perspective view of the portable pail in a fully telescoped position.

FIG. 3 is a perspective view illustrating one variety of a stiffener bar option to be fitted on the portable pail.

FIG. 4 is a perspective view illustrating another variety of a stiffener bar option to be fitted on the portable pail.

FIG. 5 is a perspective view illustrating yet another variety of a stiffener bar option to be fitted on the portable pail.

FIG. 6 is a cross section view taken along line 6—6 of FIG. 2.

FIG. 7 is a perspective view of the portable pail having a fabric handle attached thereon.

DETAILED DESCRIPTION

In accordance with this invention it has been found that a novel pail is provided. It has also been found that such a pail is provided which is self-supporting. It has further been found that such a pail is collapsible to a small volume and may be easily packed in a small space and transported to a remote location such as those encountered on a fishing trip.

Various other advantages and features will become apparent from a reading of the following description given with reference to the various figures of drawing.

As seen in FIG. 1, portable pail 10 is provided which may be collapsed in a nested assembly. The portable pail 10 comprises a plurality of tapered side sections 12, 13 and 14 which are nested one to another in series such that the sections 12, 13 and 14 may be collapsed into a completed nested assembly as shown in FIG. 1. The tapered side sections 12 include at least a top side section 13 and a bottom side section 14 which is shown in partial phantom nested within top side section 13 and middle side section 12. Side sections 12, 13 and 14 are constructed from semi-rigid material in order to aid in the side sections 12, 13 and 14 being collapsible into a completed nested assembly as shown in FIG. 1 and extended to a fully telescoped assembly in the form of a pail as shown in FIG. 2.

The portable pail 10 further comprises a closed bottom (seen in FIG. 6) which is generally perpendicular to side sections 12, 13 and 14 and connectedly adjoins bottom side section 14. Bottom side section 14 forms a thick ridge 18 around the bottom of the side section 14, and the top side section 13 also forms a thick ridge 20 around the tip of side section 13. As seen in FIG. 1, the thick ridge 20 of top side section 13 also includes a handle provision 22 for attaching a handle to the portable pail 10.

In its fully telescoped assembly, portable pail 10 includes stiffener bars (seen in FIG. 2). Tapered side sections 12, 13 and 14, in a preferred embodiment, define locating slots 24 to maintain such stiffener bars in position.

FIG. 2 is a perspective view of the portable pail 10 in a fully telescoped position. The side sections 12, 13 and 14 are tapered and are nested one to another in series and extended to a fully telescoped assembly to form a pail as shown. Top side section 13 forms a thick ridge 20 around the tip of the side section 13, and a handle provision 22 is defined by thick ridge 20. A handle 26 is shown attached to handle provisions 22 with the handle 26 being a rigid handle which can snap into handle provisions 22. Bottom side section 14 forms a thick ridge 18 around the bottom thereof which is more clearly seen in FIG. 2 than in FIG. 1.

Stiffener bars 28 are also illustrated in FIG. 2, as they help maintain portable pail 10 in a fully telescoped position and provide further rigidity to portable pail 10. Stiffener bars 28 are fitted lengthwise between the thick ridge 18 of bottom side section 14 and the thick ridge 20 of top side section 13. Stiffener bars 28 are also fitted between locating slots 24 which are defined by side sections 12, 13 and 14 in an aligned position. It is contemplated that a variety of stiffener bars 28 may be used with portable pail 10. FIG. 3 is one example of such variety as stiffener bar 30 is shown comprising a bar which may be extended to a desired length. FIG. 4 illustrates that stiffener bar 32 may also be used with portable pail 10, as stiffener bar 32 comprises a folding bar. Finally, FIG. 5 illustrates a third stiffener bar option wherein stiffener bar 34 comprises a solid bar.

FIG. 6 is a cross section view taken along line 6—6 of FIG. 2. As shown, side section 12 and bottom side section 14, are nested one to another in series such that the sections 12 and 14 may be collapsed into a nested assembly or extended to a fully telescoped assembly. At the connection of bottom side section 14 with side section 12, a sealing material 36 may be used so that pail 10 can retain liquids therein. Stiffener bar 28 is shown fitted in the thick ridge 18 formed at the bottom of bottom side section 14. Also shown in FIG. 6 is the closed bottom 37 of portable pail 10 which connectedly adjoins bottom side section 14.

FIG. 7 is a perspective view of the portable pail 10 having a fabric handle 38 attached thereon. Fabric handle 38 differs from the rigid handle 26 shown in FIG. 2, and these features of the invention enable portable pail 10 to be adaptable for various desired uses. Since portable pail 10 may be collapsed into a completed nested assembly as shown in FIG. 1, it may be advantageous for fabric handle 38 to be used with pail 10 so that portable pail 10 is easily transportable and takes up as little space as necessary.

It is thus seen that the present invention provides a novel pail. It is further seen that the present invention provides such a pail which is self-supporting and is collapsible to a small volume. It is still further seen that the present invention provides such a portable pail which may be easily packed in a small space and transported to a remote location such as those encountered on a fishing trip. Many variations are apparent to those of skill in the art, and such variations are embodied within the spirit and scope of the present invention as measured by the following appended claims.

That which is claimed is:

1. A portable pail having an open top comprising:

a plurality of tapered side sections including at least a top and bottom side section;

said side sections being constructed from semi-rigid material and nested one to another in series such that said sections may be collapsed into a completed nested assembly or extended to a fully telescoped assembly in the form of a pail;

locating slots defined by each of said side sections;

a closed bottom, said bottom being generally perpendicular to said side sections and connectedly adjoining said bottom side section;

said top side section forming a thick ridge around the tip thereof and said bottom side section forming a thick ridge around the bottom thereof;

a stiffener bar fitted lengthwise between and held in place by said ridge of said top side section and said ridge of said bottom side section when said sections are fully telescoped, said stiffener bar also engaged and held in position by said locating slots of each of said side sections;

a handle attached to said top side section in said pail.

2. The pail according to claim 1 further including additional stiffener bars fitted lengthwise between and held in place by said ridge of said top side section and said ridge of said bottom side section.

3. The pail according to claim 1 wherein said handle is constructed from fabric.

4. The pail according to claim 1 wherein said stiffener bar comprises a solid bar.

5. The pail according to claim 1 wherein said stiffener bar comprises a folding bar.

6. The pail according to claim 1 wherein said stiffener bar comprises an extendable bar.

* * * * *